US009623666B2

(12) United States Patent
Yanagisawa et al.

(10) Patent No.: US 9,623,666 B2
(45) Date of Patent: Apr. 18, 2017

(54) LIQUID EJECTING APPARATUS

(71) Applicant: SEIKO EPSON CORPORATION, Tokyo (JP)

(72) Inventors: Hirofumi Yanagisawa, Shiojiri (JP); Kenichi Miyazaki, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/972,745

(22) Filed: Dec. 17, 2015

(65) Prior Publication Data

US 2016/0200109 A1 Jul. 14, 2016

(30) Foreign Application Priority Data

Jan. 9, 2015 (JP) ..... 2015-003204

(51) Int. Cl.
*B41J 2/175* (2006.01)
*B41J 2/17* (2006.01)
*B41J 11/00* (2006.01)

(52) U.S. Cl.
CPC ..... *B41J 2/1752* (2013.01); *B41J 11/001* (2013.01)

(58) Field of Classification Search
CPC .. B41J 2/17513; B41J 2/1752; B41J 2/17553; B41J 2/175; B41J 2/17523; B41J 29/13; B41J 2/17509; B41J 29/02; B41J 11/001
USPC ..... 347/84–87, 108
See application file for complete search history.

(56) References Cited

U.S. PATENT DOCUMENTS

2012/0038719 A1* 2/2012 Shimizu ..... B41J 2/17523 347/86
2014/0063142 A1 3/2014 Miyazaki et al.
2014/0063150 A1 3/2014 Miyazaki et al.

FOREIGN PATENT DOCUMENTS

JP 2006-044116 A 2/2006
JP 2009-202347 A 9/2009
JP 2014-046567 A 3/2014
JP 2014-046568 A 3/2014
JP 2014-046588 A 3/2014
JP 2014-094536 A 5/2014

* cited by examiner

*Primary Examiner* — Jannelle M Lebron
(74) *Attorney, Agent, or Firm* — Workman Nydegger

(57) ABSTRACT

A liquid ejecting apparatus includes a liquid ejecting unit which can eject liquid; a connection unit to which a liquid container which can accommodate the liquid is connected; a housing which accommodates the liquid ejecting unit and the connection unit; a housing support unit which supports the housing; and a load transmission unit which supports a protruding portion which is a part of the liquid container, and protrudes from the housing in a state of being connected to the connection unit. The load transmission unit is connected to the housing support unit in a form capable of transmitting a load which is received by the protruding portion.

6 Claims, 5 Drawing Sheets

LIQUID EJECTING APPARATUS

BACKGROUND

1. Technical Field

The present invention relates to a liquid ejecting apparatus which can eject liquid.

2. Related Art

In the related art, there is an ink jet printer which performs printing by ejecting ink which is accommodated in an ink cartridge which is an example of a liquid container onto a medium such as a sheet, as a liquid ejecting apparatus which can eject ink. In such a printer, in general, supplying of ink is performed by exchanging an ink cartridge with a new ink cartridge by adopting a configuration in which the ink cartridge can be detachable in a housing thereof.

However, since the ink cartridge should be set to a size which can be accommodated in the housing, in a case in which it is difficult to make an apparatus large, printing of a large volume is performed, or the like, it is necessary to perform exchanging work by stopping printing every time ink in the ink cartridge is used up.

Therefore, there is a printer in which supplying of ink is performed by injecting ink into a carriage-type intermediate ink tank which is connected to a housing through an ink tube from an ink pack which is provided on the outside of the housing, in order to reduce such exchanging work of an ink cartridge (for example, refer to JP-A-2009-202347).

Meanwhile, in a case in which a part of the above described intermediate ink tank protrudes from the housing in a direction which intersects a vertical direction, there is a concern that the protruding portion may be applied with an excessive load when an object is placed on the protruding portion. In addition, when a load which can rotate a protruding end side thereof is applied to the protruding portion of the intermediate ink tank, there is a problem in that a connection of the intermediate ink tank with the housing is disconnected.

In addition, such a problem is not limited to a printer in which ink is supplied from an ink pack which is provided on the outside of a housing, and is common to a liquid ejecting apparatus in which a part of a liquid container protrudes on the outside of a housing when the liquid container is connected to the housing.

SUMMARY

An advantage of some aspects of the invention is to provide a liquid ejecting apparatus in which it is possible to suppress an influence which is caused when a portion of a liquid container connected to a housing which protrudes from the housing is applied with a load.

Hereinafter, a unit for solving the above described problem, and operational effects thereof will be described.

According to an aspect of the invention, there is provided a liquid ejecting apparatus which includes a liquid ejecting unit which can eject liquid; a connection unit to which a liquid container which can accommodate the liquid is connected; a housing which accommodates the liquid ejecting unit and the connection unit; a housing support unit which supports the housing; and a load transmission unit which supports a protruding portion which is a part of the liquid container, and protrudes from the housing in a state of being connected to the connection unit, in which the load transmission unit is connected to the housing support unit in a form capable of transmitting a load which is received by the protruding portion.

According to the configuration, it is possible to support the protruding portion so as not to be displaced while suppressing an influence on constituent elements in the housing by transmitting a load to the housing support unit using the load transmission unit, when the load is applied to the protruding portion of the liquid container which is connected to the connection unit. Accordingly, it is possible to suppress an influence which is caused when a portion of the liquid container connected to the housing which protrudes from the housing is applied with a load.

The liquid ejecting apparatus may further include a container support unit which comes into contact with the protruding portion when the liquid container is connected to the connection unit, in which a load which is received by the protruding portion is transmitted to the load transmission unit through the container support unit.

According to the configuration, by including the container support unit which comes into contact with the protruding portion of the liquid container as a separate body from the load transmission unit, it is possible to form the container support unit according to a shape, or the like, of the protruding portion, and to form the load transmission unit in a shape in which it is possible to efficiently transmit a load to the housing support unit.

The liquid ejecting apparatus may further include a plurality of the connection units to which one liquid container is connected, in which the container support unit comes into contact with a plurality of the protruding portions, and transmits loads which are received by the plurality of protruding portions to the load transmission unit.

According to the configuration, even when a plurality of liquid containers are connected, it is possible to transmit loads which are received by the plurality of protruding portions to the load transmission unit using the container support unit which comes into contact with the plurality of protruding portions.

In the liquid ejecting apparatus, in the load transmission unit, an area of a plane which receives a load through the container support unit may be smaller than a projection area which is formed when the protruding portion is projected onto a horizontal plane.

According to the configuration, in the load transmission unit, since the area of the plane which receives a load through the container support unit is smaller than the projection area which is formed when the protruding portion is projected onto a horizontal plane, it is possible to make the load transmission unit small.

In the liquid ejecting apparatus, the load transmission unit may be arranged at a lower part in a vertical direction compared to the protruding portion.

According to the configuration, it is possible to further stably support the protruding portion when a load which rotates a protruding end of the protruding portion toward the lower part in the vertical direction is applied to the protruding portion, by arranging the load transmission unit at the lower part in the vertical direction compared to the protruding portion of the load transmission unit.

The liquid ejecting apparatus may further include a relay member which is arranged so as to come into contact with the load transmission unit, and transmits a load which is received by the protruding portion to the load transmission unit, in which a relative position of the relay member with respect to the load transmission unit can be adjusted.

According to the configuration, even when an error occurs at a position of the load transmission unit, it is possible to reliably perform a transmission of a load by adjusting the relative position of the relay member with respect to the load transmission unit.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of the liquid ejecting apparatus will be described with reference to drawings.

Figure 1:
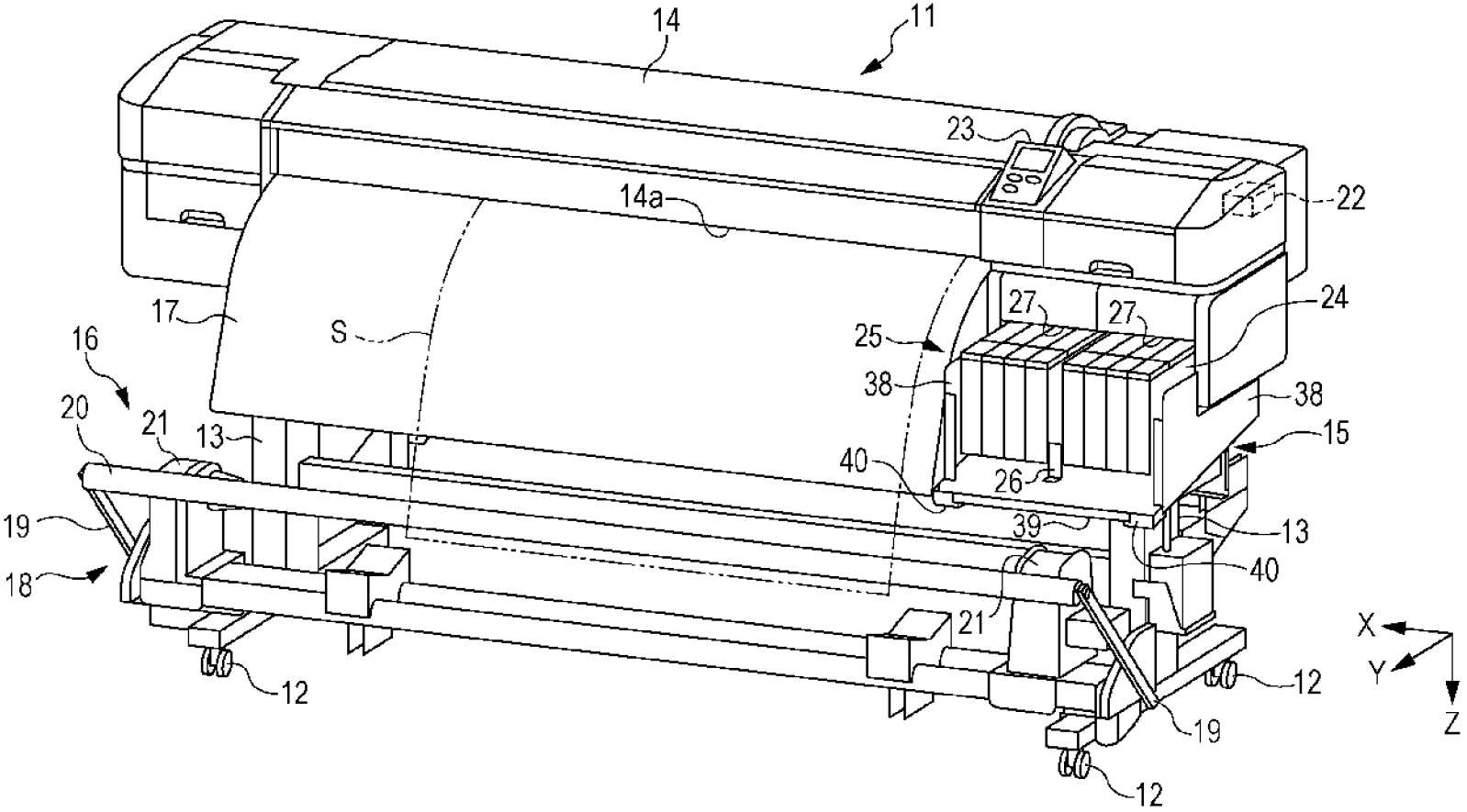
FIG. 1 is a perspective view which illustrates an embodiment of a liquid ejecting apparatus.

As illustrated in FIG. 1, a liquid ejecting apparatus 11 according to the embodiment is a large format printer (LFP) which treats a long medium S such as a roll sheet. In addition, the liquid ejecting apparatus 11 includes a housing support unit 13 to which a wheel 12 is attached at a lower end, and a housing 14 which is assembled on the housing support unit 13. According to the embodiment, the housing support unit 13 is a pair of leg portions which supports the housing 14; however, it is also possible to change the housing support unit to another shape such as leg portions of three or more with no wheels, a box-shaped base, or the like.

In the embodiment, a direction which intersects (orthogonal in the embodiment) a gravity direction Z (lower part in vertical direction), and goes toward the front face from the rear portion of the housing 14 is set to a front direction Y. In addition, a direction which intersects both the gravity direction Z and the front direction Y (orthogonal in the embodiment), and goes from one end side (right end side in FIG. 1) toward the other end side (left end side in FIG. 1) is set to a movement direction X.

A feeding unit 15 which feeds a medium S toward the housing 14 side is arranged at a lower part on the rear side of the housing 14. A winding unit 16 which is supported by the housing support unit 13 is arranged at a lower part on the front side of the housing 14. A medium supporting unit 17 is arranged between the feeding unit 15 and the winding unit 16 along a transport path of the medium S. A discharging port 14*a* for discharging the medium S from the housing 14 is formed at a position which is a higher side of the medium supporting unit 17 on the front face side of the housing 14.

A tension applying mechanism 18 which applies tension to the medium S which is located between the medium supporting unit 17 and the winding unit 16 is provided in the vicinity of the winding unit 16. The tension applying mechanism 18 is provided with a pair of arm members 19 which is rotatably supported at the lower part of the housing support unit 13, and a tension roller 20 which is rotatably supported at a tip end portion of the pair of arm members 19.

The winding unit 16 includes a pair of holders 21 which interposes a core member (not illustrated) (for example, paper tube) which winds up the medium S after being printed in a cylindrical shape. In addition, the medium S is wound around the core member which is mounted between the pair of holders 21 when one (right side in FIG. 1) of the holders 21 rotates. That is, the winding unit 16 configures a transport mechanism, and the holder 21 is located on the downstream side of the transport path of the medium S. In addition, the winding unit 16 according to the embodiment is a spindleless type in which a spindle is not used; however, it may be a type in which a spindle is used.

A control unit 22 which controls operations of the liquid ejecting apparatus 11 is provided in the housing 14. In addition, an operation panel 23 which performs a setting operation, or an input operation is provided on one end side (right end side in FIG. 1) which is the outer side on the transport path of the medium S in the movement direction X, at the higher part of the housing 14.

In addition, the operation panel 23 is electrically connected to the control unit 22.

Two accommodating units 27 which are capable of accommodating a part of a liquid container 24 which can accommodate liquid such as ink, for example, are provided at one end side (right end side in FIG. 1) which is the outer side on the transport path of the medium S in the movement direction X, at the lower part of the housing 14.

A plurality of (five in the embodiment) the liquid containers 24 which are prepared according to types and colors of liquid can be inserted into one accommodating unit 27, and according to the embodiment, four liquid containers 24 are accommodated in two accommodating units 27. In addition, the plurality of liquid containers 24 which are accommodated in one accommodating unit 27 is referred to as one liquid accommodating unit 25. It is possible to arbitrarily change the number of liquid containers 24 which can be accommodated in one accommodating unit 27, the number of liquid containers 24 which configure the liquid accommodating unit 25, and the number of liquid accommodating units 25 (that is, the number of accommodating units 27).

A protecting plate 38 which protects the liquid container 24, a liquid receiving unit 39 which can receive liquid which is leaked from the liquid container 24, and a liquid storage member 40 which can store liquid which is received using the liquid receiving unit 39 are provided at the periphery of the liquid accommodating unit 25 of two sets.

Figure 2:
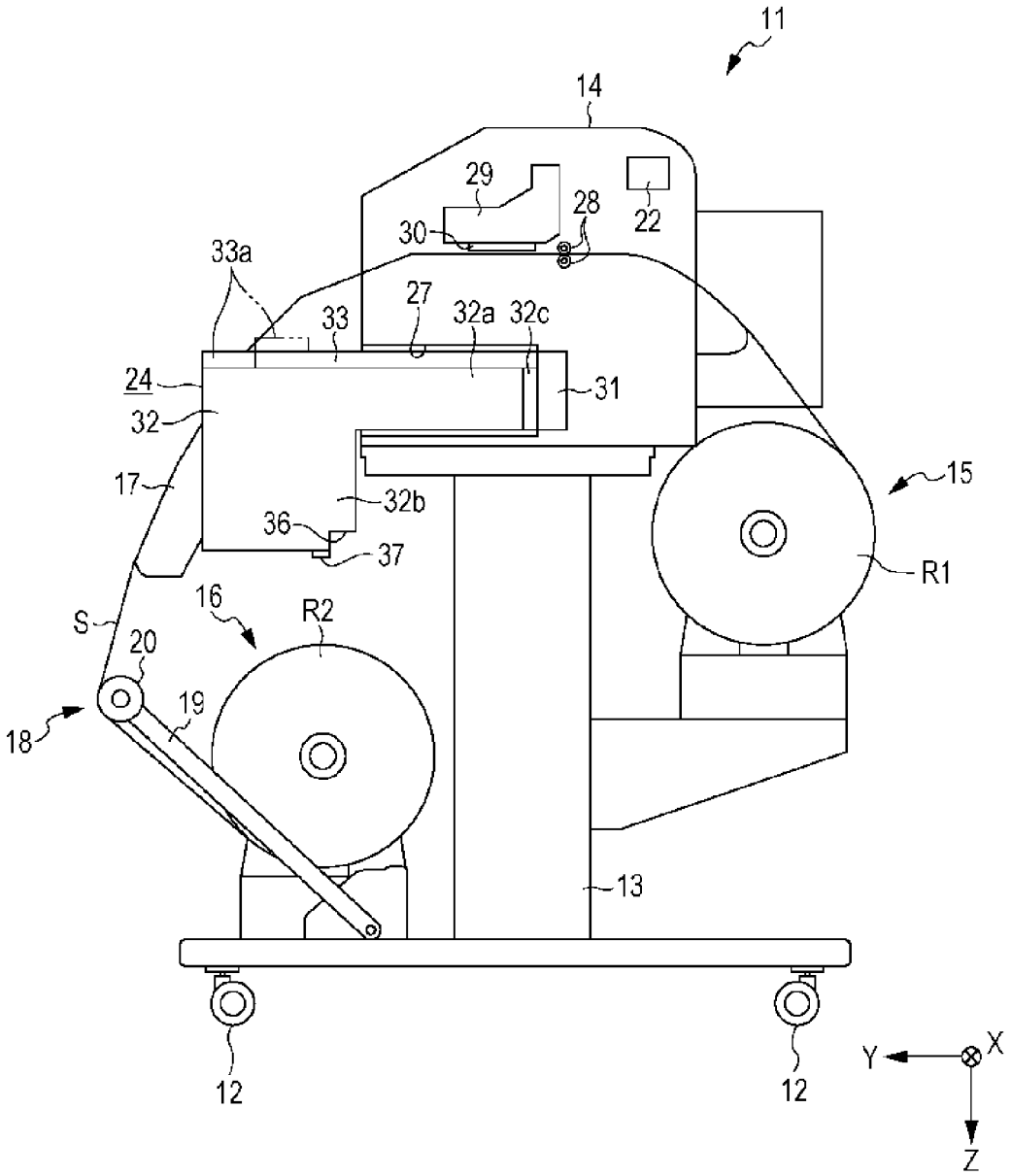
FIG. 2 is a schematic view which illustrates an internal configuration when the liquid ejecting apparatus illustrated in FIG. 1 is viewed from the side.

As illustrated in FIG. 2, a roll body R1 around which the medium S which is not used is wound in a cylindrical shape is held in the feeding unit 15. In addition, in the housing 14, a pair of transport rollers 28 which transports the medium S which is sent from the feeding unit 15, and a carriage 29 which performs a reciprocating movement in the movement direction X which is orthogonal to the transport direction of the medium S are accommodated. A liquid ejecting unit 30 which can eject liquid such as ink, for example, is held at the lower part of the carriage 29. In addition, recording (printing) is performed when the liquid ejecting unit 30 ejects ink which is supplied from the liquid container 24 onto the medium S which is transported along the transport path. That is, the liquid ejecting apparatus 11 includes the liquid ejecting unit 30 which can eject liquid. In addition, the housing 14 accommodates the liquid ejecting unit 30.

A heater (not illustrated) for drying liquid which is attached to the medium S is built into the medium supporting unit 17. In addition, the medium S after printing is guided obliquely downward along the medium supporting unit 17, is wound using the winding unit 16 thereafter, and forms a roll body R2.

In the housing 14, a plurality of connection units 31 for connecting the liquid container 24 are provided on the deep side of the accommodating unit 27. In other words, the liquid ejecting apparatus 11 includes the connection unit 31 to which the liquid container 24 which can accommodate liquid is connected. In addition, the housing 14 accommodates the liquid container 24. The liquid container 24 includes a liquid accommodating body 32 which can accommodate liquid in the inside, and a slider 33 which can move in a sliding manner in the front direction Y along a top face of the liquid accommodating body 32. A part on the front end side of the slider 33 becomes a rotatable lid unit 33*a*. The lid unit 33*a* of the slider 33 is arranged at an open position which is denoted by a two-dot chain line by being rotated upward from a closed position which is denoted by a solid line in FIG. 2.

The liquid accommodating body 32 includes a base end portion 32*a* which is accommodated in the accommodating unit 27, and a protruding portion 32*b* which protrudes from the housing 14 in a protruding direction (front direction Y in the embodiment) which intersects the gravity direction Z.

A liquid deriving unit 32*c* which is connected to the connection unit 31 in the housing 14 in a state of being capable of deriving liquid is provided in the base end portion 32*a*, in the liquid accommodating body 32.

In addition, in the liquid container 24, when the base end portion 32*a* is accommodated in the accommodating unit 27 along with a movement in a connecting direction (according to the embodiment, rear side which is direction opposite to protruding direction), the liquid deriving unit 32*c* is connected to the connection unit 31. In the liquid container 24 which is connected to the connection unit 31, a base portion of the base end portion 32*a* is supported by an inner base portion of the accommodating unit 27.

In the state in which the liquid container 24 is accommodated in the connection unit 31, the protruding portion 32*b* of the liquid accommodating body 32 is extended downward compared to the base end portion 32*a* side. In addition, a base portion on the protruding portion 32*b* side in the liquid container 24 is arranged downward compared to the base portion of the housing 14.

In the liquid accommodating body 32, a base portion with step difference 36 is formed at the rear side lower portion of the protruding portion 32*b*. In addition, in the liquid accommodating body 32, a protruding portion for screwing 37 protrudes at a position which is the front side of the base portion with step difference 36 at the lower end portion of the protruding portion 32*b*. In the following descriptions, in the protruding portion 32*b* of the liquid accommodating body 32, an end portion on a side on which the base portion with step difference 36 is provided in the anteroposterior direction will be referred to as a rear end side, and an end portion on the front side which is a side opposite thereto will be referred to as a protruding end side.

Figure 3:
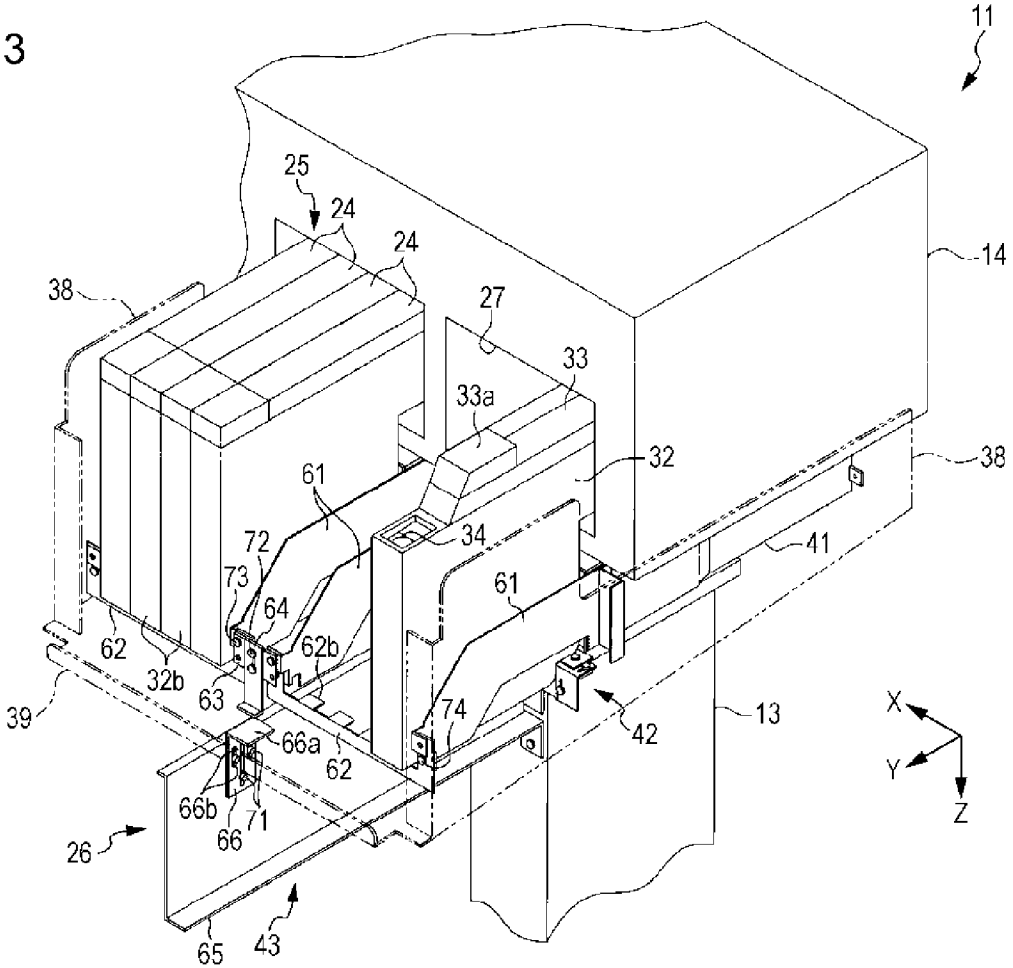
FIG. 3 is a perspective view of a liquid container and a support unit.

When the lid unit 33*a* of the slider 33 is arranged at the open position like the liquid container 24 which is located at the right end in FIG. 3, an inlet 34 of liquid which is formed on a top face side of the liquid accommodating body 32 is exposed. In addition, in the liquid container 24, when liquid is injected from the inlet 34, liquid is accommodated in the liquid accommodating body 32. In addition, liquid which is spilled when injecting liquid from the inlet 34, or the like, is received by the liquid receiving unit 39.

Here, in the liquid container 24, there is also a case in which an amount of liquid which is stored in the protruding portion 32*b* which protrudes from the housing 14 is larger than an amount of liquid which is stored on the base end portion 32*a* side, and when liquid is injected, a center of gravity moves forward. In addition, since the protruding portion 32*b* protrudes from the housing 14, there is a concern that an excessive load may be applied to the protruding portion 32*b*, when work of injecting liquid from the inlet 34 is performed, stuff is unintentionally placed on the protruding portion 32*b*, or the like, for example.

In such a case, there is a concern that a connection failure with respect to the connection unit 31 of the liquid deriving unit 32*c* may occur due to floating of the base end portion 32*a*, and as a result, liquid may be leaked, or air may be mixed, when a protruding end of the protruding portion 32*b* is lowered, and the liquid container 24 rotates. In order to reduce such a risk, in the liquid ejecting apparatus 11 according to the embodiment, a support unit 26 which supports the protruding portion 32*b* of the liquid container 24 on the outside of the housing 14 is provided. It is preferable to arrange the support unit 26 at the lower part in the vertical direction compared to the liquid container 24 in order to efficiently support the weight of the liquid container 24 itself, and a load which is applied to the protruding portion 32*b*.

Subsequently, a configuration of the support unit 26 will be described in detail.

As illustrated in FIG. 3, the support unit 26 includes a support frame 41 (refer to FIG. 4 together) which is provided in each of the liquid accommodating unit 25 in the form of being connected to the housing 14, a rear end support unit 42 which can support the rear end side of the protruding portion 32*b* in the liquid accommodating body 32, and a protruding end support unit 43 which can support the protruding end side of the protruding portion 32*b*.

In addition, in FIG. 3, a liquid storage member 40 is not illustrated, and the protecting plate 38 and the liquid receiving unit 39 are denoted using a two-dotted chain line in order to clearly state configurations of the rear end support unit 42 and the protruding end support unit 43. The protecting plates 38 are supported by the housing 14 through the support frame 41 so as to interpose the liquid accommodating unit 25 of two sets therebetween. The liquid receiving unit 39 is connected to the lower end portion of the protecting plate 38 in a form of being arranged at the lower part of the protruding portion 32*b* in the vertical direction of the liquid accommodating unit 25 of two sets.

Subsequently, a configuration of the protruding end support unit 43 will be described in detail.

The protruding end support unit 43 includes two pairs of side support units 61 (refer to FIG. 4 together) of which base end sides are respectively fixed to both end faces of the two support frames 41 in the movement direction X, and two container support units 62 of which both end portions are fixed to tip end portions of the side support units 61 which form a pair. In addition, the protruding end support unit 43 includes a rectangular plate-shaped connecting member 63 which connects the two container support units 62 which are aligned in the movement direction X, and a first adjusting member 64 which is connected to the front face side of the connecting member 63.

In addition, the protruding end support unit 43 includes a load transmission unit 65 of which a base end side is connected to the housing support unit 13, and is extended in a protruding direction from the housing support unit 13, and a plate-shaped second adjusting member 66 which is screwed to a tip end portion of the load transmission unit 65. The first adjusting member 64 and the second adjusting member 66 are aligned in the vertical direction by interposing the liquid receiving unit 39 therebetween, and transmit a load which is received by the container support unit 62 to the load transmission unit 65. The load transmission unit 65 has a configuration in which it is possible to support the protruding portion 32*b* which is a part of the liquid container 24 which protrudes from the housing 14 in a state of being connected to the connection unit 31. The load transmission unit 65 is arranged at the lower part in the vertical direction compared to the protruding portion 32*b*. In addition, the container support unit 62 comes into contact with the protruding portion 32*b* when the liquid container 24 is connected to the connection unit 31.

The load transmission unit 65 is connected to the housing support unit 13 in a form in which a load which is received by the protruding portion 32*b* as a part of the liquid container 24 which protrudes from the housing 14 can be transmitted, in a state of being connected to the connection unit 31. In addition, the load which is received by the protruding portion 32*b* is transmitted to the load transmission unit 65 through the container support unit 62. More specifically, the load which is received by the protruding portion 32*b* is transmitted to the housing support unit 13 through the container support unit 62, the side support unit 61, the connecting member 63, the first adjusting member 64, the liquid receiving unit 39, the second adjusting member 66, and the load transmission unit 65 in order.

An abutting plate unit 66*a* which comes into contact with a lower face of the liquid receiving unit 39 is provided at a higher end of the second adjusting member 66 in the vertical direction. In addition, one, or a plurality of long holes 66*b* are formed in a form of being extended in the vertical direction at a portion of the second adjusting member 66, which comes into contact with the load transmission unit 65. A relative position of the second adjusting member 66 with respect to the liquid receiving unit 39 and the load transmission unit 65 is changed when the second adjusting member moves in the vertical direction in a state in which a lower side adjusting screw 71 which is inserted into the long hole 66*b* is loosened. In addition, the second adjusting member 66 is fixed to the load transmission unit 65 by being screwed, after a position of the abutting plate unit 66*a* in the vertical direction is adjusted so as to come into contact with the lower face of the liquid receiving unit 39.

That is, the second adjusting member 66 is arranged so as to come into contact with the load transmission unit 65, and functions as a relay member which transmits a load which is received by the protruding portion 32*b* to the load transmission unit 65. In addition, a position of the second adjusting member 66 relative to the load transmission unit 65 can be adjusted. In conclusion, the liquid ejecting apparatus 11 includes the relay member which is arranged so as to come into contact with the load transmission unit 65, and transmits a load which is received by the protruding portion 32*b* to the load transmission unit 65. In addition, the relay member is configured so that a relative position with respect to the load transmission unit 65 can be adjusted.

Figure 4:
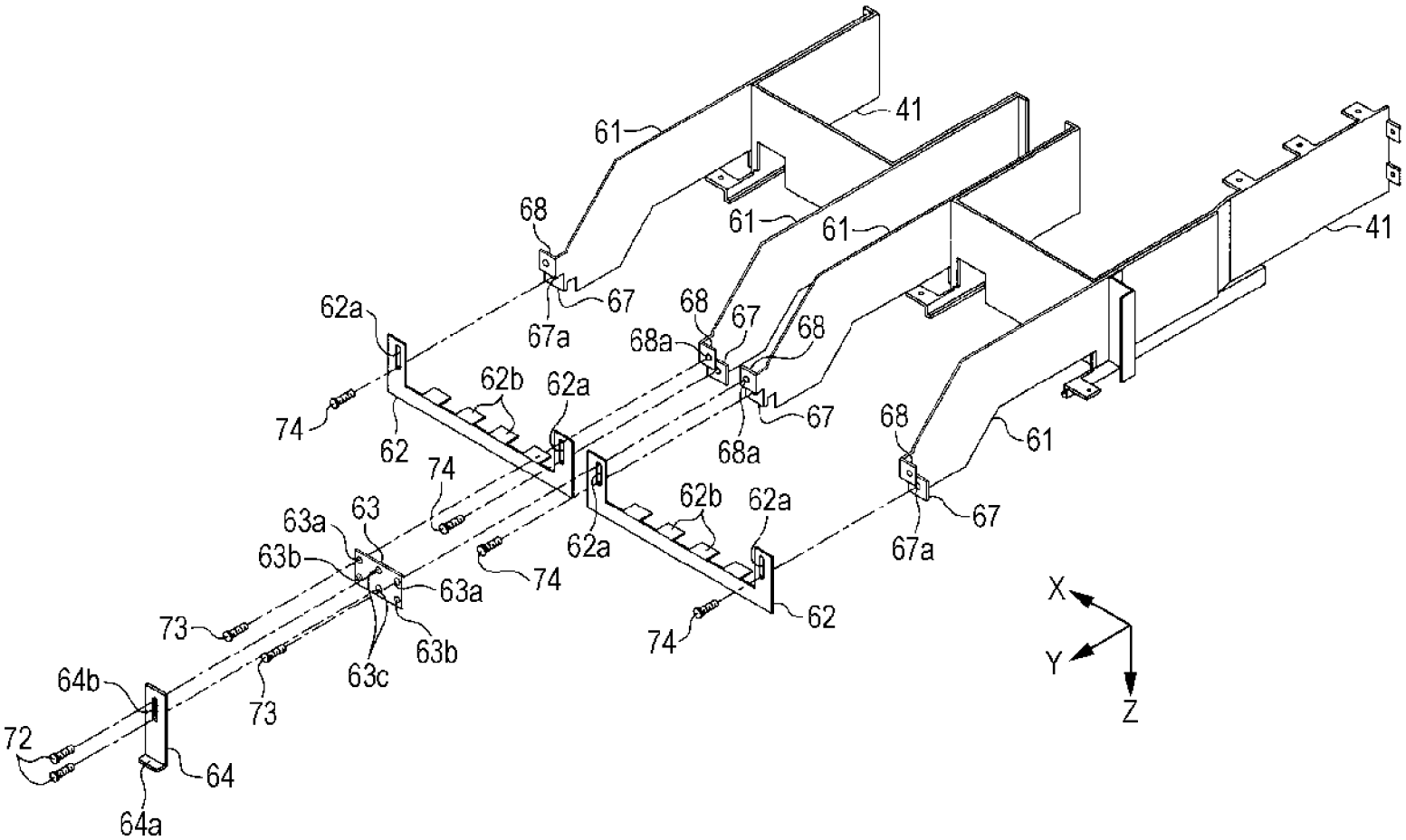
FIG. 4 is an exploded perspective view which illustrates a part of a protruding end support unit.

As illustrated in FIG. 4, an abutting plate unit 64*a* which comes into contact with a top face of the liquid receiving unit 39 (refer to FIG. 3) is provided at a lower end of the first adjusting member 64 in the vertical direction. In addition, the long hole 64*b* is formed at a portion of the first adjusting member 64 which comes into contact with the connecting member 63 in a form of being extended in the vertical direction.

Fixing plate units 67 and 68 which are extended in the movement direction X and the gravity direction Z so as to be parallel to each other are provided at a tip end of the side support unit 61. According to the embodiment, the fixing plate unit 67 is arranged at a position which is close to the support frame 41 in the protruding direction compared to the fixing plate unit 68. Screwing holes 67*a* and 68*a* are respectively formed in the fixing plate units 67 and 68.

Long holes 62*a* which are extended in the vertical direction are formed at both end portions of the container support unit 62 in the movement direction X which is longitudinal direction. In addition, the container support unit 62 is provided with a contact unit 62*b* which extends in the protruding direction and the movement direction X between two long holes 62*a* which form a pair in the longitudinal direction thereof. The contact unit 62*b* comes into contact with the protruding portion 32*b* when the liquid container 24 is connected to the connection unit 31. As in the embodiment, it is possible to intermittently provide the contact unit 62*b* at positions corresponding to the liquid accommodating body 32, and to set the contact unit so as to have a long shape which extends in the movement direction X so as to come into contact with the plurality of liquid accommodating bodies 32.

The two container support units 62 are screwed to the fixing plate unit 67 of the side support unit 61 using a support position adjusting screw 74 which is inserted into screwing holes 67*a* which are formed in the pair of long holes 62*a*, and the fixing plate units 67 which form a pair, similarly.

A position of the container support unit 62 in the vertical direction can be adjusted when the container support unit 62 is moved in a state in which the support position adjusting screw 74 which is inserted into the long hole 62*a* is loosened. That is, the container support unit 62 has a configuration in which a relative position with respect to the side support unit 61 and the protruding portion 32*b* of the liquid container 24 can be adjusted.

In the connecting member 63, a first screw hole 63*a* and a through hole 63*b* are formed in a form of being vertically aligned in the vertical direction at both end portions in the movement direction X, and one, or a plurality of second screw holes 63*c* are formed in the vicinity of a center in the movement direction X. In addition, the support position adjusting screw 74 which is arranged on the rear side of the connecting member 63 can be operated through the through hole 63*b* of the connecting member 63.

The connecting member 63 is arranged so that the first screw hole 63*a* on one side (left side in FIG. 4) overlaps the fixing plate unit 68 of the side support unit 61 which is attached to a face on the right side of the support frame 41 which is located on one side (left side in FIG. 4). In addition, the connecting member 63 is arranged so that the first screw hole 63*a* on the other side (right side in FIG. 4) overlaps the fixing plate unit 68 of the side support unit 61 which is attached to a face on the left side of the support frame 41 which is located on the other side (right side in FIG. 4). In addition, the connecting member 63 is screwed to the two adjacent fixing plate units 68 using connection fixing screws 73 which are inserted into the first screw hole 63*a* of two and the screwing hole 68*a*.

That is, according to the embodiment, the side support units 61 which form a pair are provided in each of the support frames 41 which are aligned in the movement direction X; however, in contrast to this, the connecting member 63, the first adjusting member 64, the second adjusting member 66, and the load transmission unit 65 (refer to FIG. 3) are arranged one by one between the two support frames 41 which are aligned in the movement direction X.

The first adjusting member 64 is allowed to move along the vertical direction by setting a state in which a higher side adjusted screw 72 of one or two or more which are inserted into the long hole 64*b*, and the second screw hole 63*c* of the connecting member 63 are loosened. In addition, the first adjusting member 64 is fixed to the connecting member 63 using screwing after a position thereof in the vertical direction is adjusted so that the abutting plate unit 64*a* comes into contact with a top face of the liquid receiving unit 39.

That is, the first adjusting member 64 is connected to a tip end of the side support unit 61 through the connecting member 63. In addition, a relative position of the first adjusting member 64 with respect to the side support unit 61 and the liquid receiving unit 39 (refer to FIG. 3) is adjusted when the first adjusting member 64 is moved along the vertical direction in a state in which the higher side adjusted screw 72 inserted into the long hole 64*b* is loosened.

Subsequently, operations of the liquid ejecting apparatus 11 which is configured as above will be described.

When the liquid container 24 which is connected to the housing 14 rotates downward on the front side due to a load which is applied to the protruding portion 32*b* which protrudes from the housing 14, or the weight of the protruding portion 32*b* itself, there is a concern that a connection of the liquid deriving unit 32*c* to the connection unit 31 may not be appropriately maintained.

In that respect, since the liquid ejecting apparatus 11 according to the embodiment includes the support unit 26 which supports the protruding portion 32*b* of the liquid container 24 from the lower part in the vertical direction on the outside of the housing 14, rotating of the liquid container 24 is suppressed. In addition, since the weight of the protruding portion 32*b* itself, or the load which is applied to the protruding portion 32*b* is supported on both sides of the housing 14 and the housing support unit 13 through the support unit 26, the load can be distributed.

In particular, there is a concern that an excessive load may be applied to the protruding end side of the liquid container 24, or there may be a large displacement due to rotating; however, the load which is applied to the protruding end side of the liquid container 24 is transmitted to the housing support unit 13 through the protruding end support unit 43. For this reason, even when the housing 14 is applied with a large load or shock, since a vibration thereof hardly reaches the liquid ejecting unit 30 in the housing 14, it is possible to suppress a deterioration in printing performance. In addition, it is possible to maintain a gravity balance of the liquid ejecting apparatus 11 by supporting the load which is applied to the protruding end side of the liquid container 24 using the housing support unit 13 which is located at a position lower than the housing 14.

In the liquid container 24 according to the embodiment, since the protruding direction thereof is the longitudinal direction, and an accommodating amount of ink of the protruding portion 32*b* which protrudes from the housing 14 is larger than that of the base end portion 32*a* which is accommodated in the housing 14, the front end side is easily tilted downward. In addition, when the liquid container 24 becomes large, since constituent members of the liquid receiving unit 39 or the support unit 26 which are provided accompanying therewith also become large, there is a concern that a manufacturing error or an installation error thereof may become large, and positions of the support unit 26 and the liquid container 24 may be deviated.

In that respect, according to the embodiment, since it is possible to adjust a position of the container support unit 62 which comes into contact with the protruding portion 32*b* of the liquid container 24 among constituent elements which configure the support unit 26, it is possible to suppress an influence of position deviations of the protruding portion 32*b*, the support frame 41 and the side support unit 61.

In addition, according to the embodiment, it is possible to adjust positions of the first adjusting member 64 and the second adjusting member 66 which are arranged at a position of interposing the liquid receiving unit 39 therebetween, among constituent elements which configure the support unit 26. In this manner, it is possible to reliably transmit a load which is applied to the protruding portion 32*b* from the load transmission unit 65 to the housing support unit 13 by suppressing the influence of the position deviation, even when an error occurs at an attaching position of the liquid receiving unit 39 or the load transmission unit 65.

In addition, since all of fixing operations of each of the constituent members in which it is possible to perform adjusting of positions are performed using a screw, when there is a screwdriver, it is possible to easily perform adjusting of positions without using a special tool.

Figure 5:
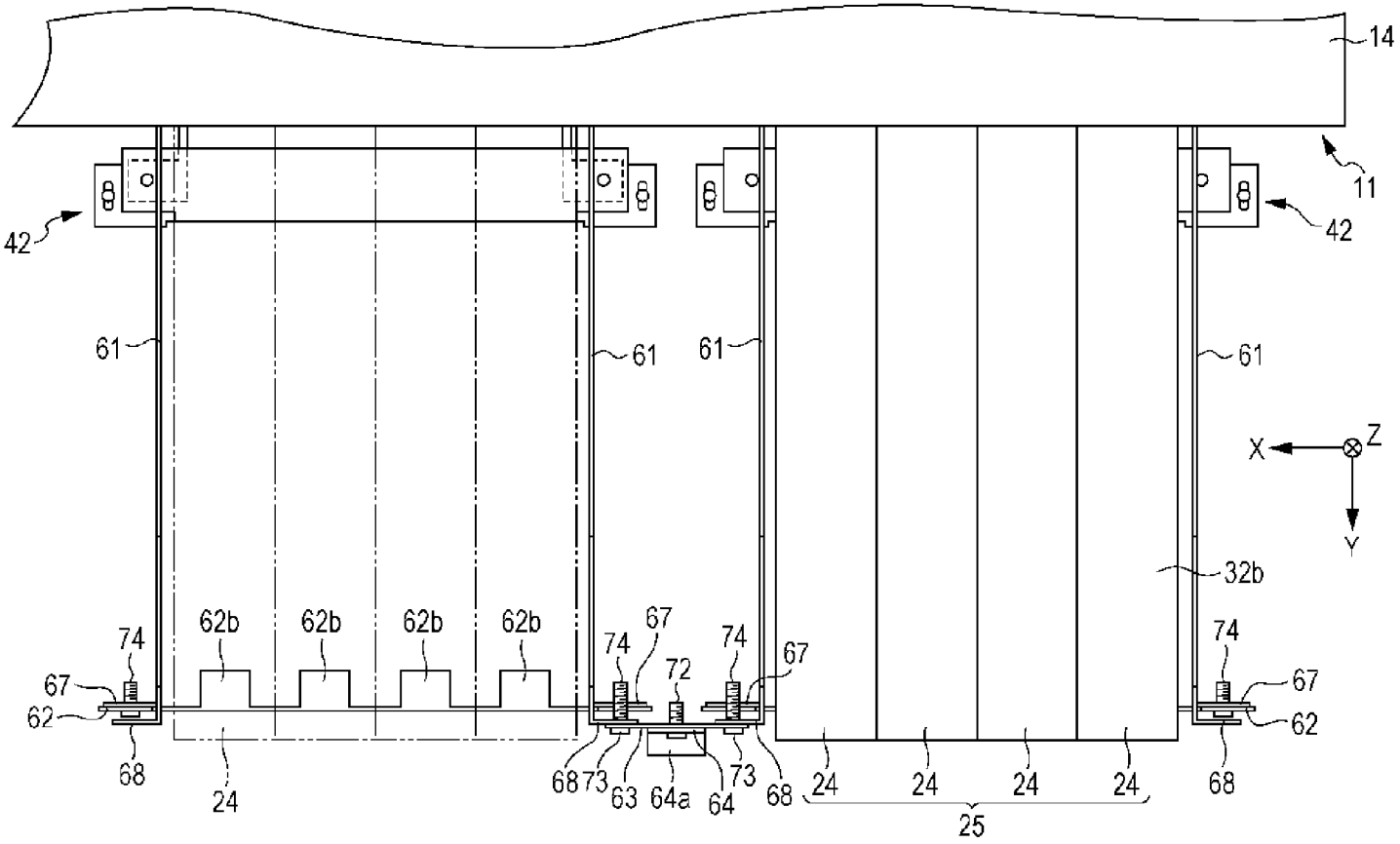
FIG. 5 is a top view of the liquid container and the protruding end support unit.

For example, as illustrated in FIG. 5, it is possible for the support position adjusting screw 74 which adjusts the position of the container support unit 62, or the higher side adjusting screw 72 which adjusts the position of the first adjusting member 64 to perform a rotating operation using a driver from the front side, using a front space of the liquid accommodating unit 25. In addition, in FIG. 5, in order to clearly illustrate the configuration of the first adjusting member 64, or the like, illustrations of the load transmission unit 65, the second adjusting member 66, the protecting plate 38, the liquid receiving unit 39, and the liquid storage member 40 are omitted.

In addition, according to the embodiment, in the load transmission unit 65, an area of a face which receives a load through the container support unit 62 (area of second adjusting member 66 which comes into contact with load transmission unit 65) is smaller than a projection area which is formed when the protruding portion 32*b* is projected onto a horizontal plane. In addition, the container support unit 62 which extends in the movement direction X comes into contact with the plurality of protruding portions 32*b*, and loads which are received by the plurality of protruding portions 32*b* are transmitted to the load transmission unit 65 through the first adjusting member 64 and the second adjusting member 66 which extend in the vertical direction. For this reason, it is possible to make an installation space of the protruding end support unit 43 smaller than a space which is necessary when arranging a box-shaped support member which supports the entire base of the protruding portion 32*b*.

In addition, the load transmission unit 65 is connected to the housing support unit 13 in a form capable of transmitting the load which is received by the protruding portion 32*b*; however, when the load transmission unit 65 is set so as to be cantilever supported by the housing support unit 13, it is possible to make the installation space of the protruding end support unit 43 at the lower part of the protruding portion 32*b* in the vertical direction small. According to the embodiment, since an arm member 19 or a holder 21 is arranged at the lower part of the protruding portion 32*b* in the vertical direction, it is particularly helpful when making the support unit 26 which is arranged at the lower part of the liquid receiving unit 39, similarly, small.

According to the embodiment, it is possible to obtain the following effects.

(1) When a load is applied to the protruding portion 32*b* of the liquid container 24 which is connected to the connection unit 31, by transmitting the load to the housing support unit 13 using the load transmission unit 65, it is possible to support the protruding portion 32*b* so as not to be displaced, while suppressing an influence on the constituent elements in the housing 14.

Accordingly, it is possible to suppress the influence which is caused when a load is applied to the portion of the liquid container 24 connected to the housing 14 which protrudes from the housing 14.

(2) It is possible to form the container support unit 62 according to a shape, or the like, of the protruding portion 32*b*, and to form the load transmission unit 65 in a shape in which it is possible to efficiently transmit a load to the housing support unit 13, by including the container support unit 62 which comes into contact with the protruding portion 32*b* of the liquid container 24 separately from the load transmission unit 65.

(3) It is possible to transmit loads which are received by the plurality of protruding portions 32*b* to the load transmission unit 65 using the container support unit 62 which comes into contact with the plurality of protruding portions 32*b*, even when the plurality of liquid containers 24 are connected.

(4) Since an area of the face in the load transmission unit 65 which receives a load through the container support unit 62 is smaller than a projection area which is formed when the protruding portion 32*b* is projected onto a horizontal plane, it is possible to make the load transmission unit 65 small.

(5) It is possible to further stably support the protruding portion 32*b* when a load which can rotate a protruding end thereof toward the lower part in the vertical direction is applied to the protruding portion 32*b*, by arranging the load transmission unit 65 at the lower part in the vertical direction, compared to the protruding portion 32*b* of the liquid container 24.

(6) It is possible to reliably transmit a load by adjusting a relative position of the second adjusting member 66 with respect to the load transmission unit 65, even when an error occurs at a position of the load transmission unit 65.

In addition, the above described embodiment may be changed as follows.

It is also possible to configure the protruding end support unit 43 using one member. In this case, the protruding end support unit 43 functions as the load transmission unit. In addition, it is also possible to configure the protruding end support unit 43 using a plurality of members which are different from those in the above described embodiment.

The liquid ejecting apparatus 11 may not include any one of the rear end support unit 42, the protecting plate 38, the liquid receiving unit 39, and the liquid storage member 40, or all of them.

When the liquid ejecting apparatus 11 does not include the liquid receiving unit 39, a configuration in which the second adjusting member 66 is not provided, and the first adjusting member 64 is directly connected to the load transmission unit 65 by being extended to the lower part in the vertical direction may be adopted. Also in this case, it is possible to suppress an influence of the position deviation of the load transmission unit 65, by moving the first adjusting member 64 which functions as a relay member in the vertical direction.

It may be a configuration in which the liquid ejecting apparatus 11 does not include the second adjusting member 66, a through hole is provided in the liquid receiving unit 39, the first adjusting member 64 is extended to the lower part in the vertical direction so as to penetrate the through hole, and is directly connected to the load transmission unit 65. Also in this case, it is possible to suppress the influence of the position deviation of the load transmission unit 65, by moving the first adjusting member 64 which functions as a relay member in the vertical direction. However, in this case, since there is a concern that liquid which is received by the liquid receiving unit 39 may be leaked from the through hole, as in the above described embodiment, it is preferable to adopt a configuration in which the liquid receiving unit 39 is interposed between the first adjusting member 64 and the second adjusting member 66.

It may be a configuration in which the protruding end support unit 43 does not include the connecting member 63, and the first adjusting member 64 is connected to each of the fixing plate units 68. However, in this case, since the first adjusting member 64 and the second adjusting member 66 are not aligned in the vertical direction, it is preferable to raise an intensity of the liquid receiving unit 39 compared to a case in which the first adjusting member 64 and the second adjusting member 66 are aligned in the vertical direction.

It may be a configuration in which the liquid container 24 does not include the inlet 34.

The number of liquid containers 24 can be arbitrarily changed. Alternatively, it may be a configuration in which the liquid accommodating unit 25 is formed of a liquid container 24 in which the inlet 34 is provided, and a liquid container 24 in which the inlet 34 is not provided. For example, in a case in which monochrome printing is performed, or the like, when the inlet 34 is provided in a liquid container 24 which corresponds to black ink, it is possible to continuously perform monochrome printing of a large volume. In addition, in this case, a configuration in which a liquid container 24 which corresponds to color ink does not include the protruding portion 32*b* and the inlet 34, and all of the liquid containers 24 are accommodated in the housing 14 may be adopted.

The liquid container 24 may not necessarily be a container which accommodates liquid which is ejected from the liquid ejecting unit 30. For example, the liquid container 24 may be a container which accommodates cleaning liquid for performing cleaning of the liquid ejecting unit 30, moisturizing liquid for suppressing drying of the liquid ejecting unit 30, liquid which is discharged from the liquid ejecting unit 30 as waste liquid for maintenance, or the like.

The liquid container 24 may be connected to the connection unit 31 in a state of accommodating liquid, or may be injected with liquid through the inlet 34 after being connected to the connection unit 31 in an empty state in which liquid is not accommodated.

It may be a configuration in which it is possible to perform injecting of ink, and printing at the same time, by connecting a downstream end of an ink tube which is connected to an ink tank, or the like, of which an upstream end is arranged on the outside of the housing 14 to the inlet 34 of the liquid container 24.

The liquid ejecting apparatus 11 may be changed to a so-called line head liquid ejecting apparatus which does not include the carriage 29, includes a long and fixed liquid ejecting unit 30, and corresponds to the entire width of the medium S, for example. The liquid ejecting unit 30 in this case may be set to a unit in which a recording range extends over the entire width of the medium S, by arranging a plurality of unit head portions in which nozzles which eject liquid as ink droplets are formed in a line, or may be set to a unit in which the recording range extends over the entire width of the medium S, by arranging a plurality of nozzles in a single long head so as to extend over the entire width of the medium S.

Liquid which is ejected or discharged from the liquid ejecting unit 30 is not limited to ink, and may be a liquid body, or the like, in which particles of a functional material are dispersed or mixed in liquid, for example. For example, it may be a configuration in which recording is performed by ejecting a liquid body including a material such as an electrode material which is used when manufacturing a liquid crystal display, an electroluminescence (EL) display, a surface light emitting display, and the like, or a coloring material (pixel material) in a form of dispersion or melting.

The entire disclosure of Japanese Patent Application No. 2015-003204, filed Jan. 9, 2015 is expressly incorporated reference herein.

What is claimed is:

1. A liquid ejecting apparatus comprising:

a liquid ejecting unit which can eject liquid;

a connection unit to which a liquid container which can accommodate the liquid is connected;

a housing which accommodates the liquid ejecting unit and the connection unit;

a housing support unit which supports the housing by having the housing be assembled on top of the housing support unit; and a load transmission unit which supports a protruding portion which is a part of the liquid container, and has a first end that protrudes from the housing and has a second end connected to the the housing support unit wherein the load transmission unit is disposed beneath the protruding portion in a vertical direction such that the protruding portion at the load transmission unit is capable of transmitting a load which is received by the protruding portion to the housing support unit.

2. The liquid ejecting apparatus according to claim 1, wherein the load transmission unit is arranged at a lower part in a vertical direction compared to the protruding portion.

3. The liquid ejecting apparatus according to claim 1, further comprising:

a relay member which is arranged so as to come into contact with the load transmission unit, and transmits a load which is received by the protruding portion to the load transmission unit, wherein a relative position of the relay member with respect to the load transmission unit can be adjusted.

4. The liquid ejecting apparatus according to claim 1, further comprising:

a container support unit which comes into contact with the protruding portion when the liquid container is connected to the connection unit, wherein a load which is received by the protruding portion is transmitted to the load transmission unit through the container support unit.

5. The liquid ejecting apparatus according to claim 4, further comprising:

a plurality of the connection units to which one liquid container is connected, wherein the container support unit comes into contact with a plurality of the protruding portions, and transmits loads which are received by the plurality of protruding portions to the load transmission unit.

6. The liquid ejecting apparatus according to claim 4, wherein, in the load transmission unit, an area of a plane which receives a load through the container support unit is smaller than a projection area which is formed when the protruding portion is projected onto a horizontal plane.

* * * * *